US007942697B2

(12) United States Patent
Bloomfield

(10) Patent No.: US 7,942,697 B2
(45) **Date of Patent: *May 17, 2011**

(54) ELECTRICAL INTERCONNECTION SYSTEMS AND METHODS OF ASSEMBLING THE SAME

(75) Inventor: John D. Bloomfield, Wallingford, CT (US)

(73) Assignee: Times Microwave Systems, Inc., Wallingford, CT (US)

( * ) Notice: Subject to any disclaimer, the term of this patent is extended or adjusted under 35 U.S.C. 154(b) by 118 days.

This patent is subject to a terminal disclaimer.

(21) Appl. No.: 12/110,139

(22) Filed: Apr. 25, 2008

(65) Prior Publication Data

US 2009/0318007 A1 Dec. 24, 2009

(51) Int. Cl.
*H01R 13/40* (2006.01)

(52) U.S. Cl. ..... 439/595; 439/744

(58) Field of Classification Search ..... 439/595, 439/603, 733.1, 744, 871

See application file for complete search history.

(56) References Cited

U.S. PATENT DOCUMENTS

| | | | | |
|---|---|---|---|---|
| 3,143,385 | A | 8/1964 | Zimmerman, Jr. et al. | |
| 3,500,297 | A * | 3/1970 | Bac | 439/737 |
| 3,596,234 | A * | 7/1971 | Sapienza et al. | 439/682 |
| 3,808,580 | A | 4/1974 | Johnson | |
| 4,012,105 | A | 3/1977 | Biddle | |
| 4,595,251 | A | 6/1986 | Moulin | |
| 4,936,662 | A | 6/1990 | Griffin | |
| 4,986,764 | A | 1/1991 | Eaby et al. | |
| 5,199,894 | A | 4/1993 | Kalny et al. | |
| 5,720,630 | A | 2/1998 | Richmond et al. | |
| 6,634,896 | B1 | 10/2003 | Potega | |
| 6,866,527 | B2 | 3/2005 | Potega | |
| 6,981,895 | B2 | 1/2006 | Potega | |
| 7,255,567 | B1 | 8/2007 | Liao | |
| 2002/0008386 | A1 | 1/2002 | Lee | |

FOREIGN PATENT DOCUMENTS

| | | | |
|---|---|---|---|
| JP | 10055843 | A | 2/1998 |
| JP | 2001126814 | A | 5/2001 |
| JP | 2005346940 | A | 12/2005 |

* cited by examiner

*Primary Examiner* — Khiem Nguyen
(74) *Attorney, Agent, or Firm* — Blank Rome LLP

(57) ABSTRACT

An electrical interconnection system is described. The electrical interconnection system comprises a first contact and a second contact configured electrically couple together. The system also comprises a receptacle assembly including a receptacle shell and a first retaining ring secured within the receptacle shell. The receptacle assembly is configured to couple the first contact to the receptacle shell. The system further comprises a plug assembly including a plug shell and a second retaining ring secured within the plug shell. The plug assembly is configured to couple the second contact to the plug shell. The receptacle shell and the plug shell are further configured to align the first contact and the second contact for coupling together.

15 Claims, 5 Drawing Sheets

ELECTRICAL INTERCONNECTION SYSTEMS AND METHODS OF ASSEMBLING THE SAME

BACKGROUND OF THE INVENTION

The field of the invention relates generally to electrical connections, and more specifically, to electrical interconnection systems that include a shell and a front release retaining ring.

Multi-conductor cable connectors are frequently used in the aircraft industry to replace, for example, threaded fasteners and bayonet-type fasteners. In at least some of such known connectors, a shell is positioned at a connection defined between two conductors to facilitate maintaining the electrical coupling of the two conductors, even in the presence of vibration, dust, water, or other contaminants. For example, one known multi-conductor cable connector includes a MIL-C-38999 style shell. Some of such connectors are known as rear release connectors. Rear release connectors may include internal leaf springs, which are accessible from a rear of the connector, that engage a shoulder on a contact in order to secure the contact within a shell. However, such contacts may be difficult to remove because a release tool must be used to release the leaf springs and to remove the contact. It may be difficult to determine when the release tool is properly positioned to release the leaf springs. If improperly positioned, the release tool may damage the leaf springs.

Another known multi-conductor cable connector includes a contact that includes a retaining ring on the contact that secures the contact within a shell. These types of electrical connectors are typically front release contacts in which the retaining ring is fabricated from a thin wall that enables it to collapse when the contact is pushed into the shell with the cable. The retaining ring may also include a lead-in chamfer to guide the retaining ring into the shell. However, such a design leaves little bearing surface to hold the contact in place, and as such, dimensional tolerances are a concern with this type of electrical connector. For example, if the retaining ring is small in comparison to the shell, the contacts may fall out. Alternatively, if the retaining ring is big in comparison to the shell, removal of the contacts may not be possible.

Other known multi-conductor cable connectors include a removable retaining ring that is used to hold a contact within a shell. However, such designs increase the possibility that the retaining ring will be misplaced and/or the retaining ring will be installed incorrectly.

As such, a durable, cost-effective multi-conductor electrical interconnect system that includes a front release connector, and a locking mechanism secured within the shell, is desirable.

BRIEF DESCRIPTION OF THE INVENTION

In one aspect, an electrical interconnection system is provided. The electrical interconnection system comprises a first contact and a second contact configured electrically couple together. The system also comprises a receptacle assembly including a receptacle shell and a first retaining ring secured within the receptacle shell. The receptacle assembly is configured to couple the first contact to the receptacle shell. The system further comprises a plug assembly including a plug shell and a second retaining ring secured within the plug shell. The plug assembly is configured to couple the second contact to the plug shell. The receptacle shell and the plug shell are further configured to align the first contact and the second contact for coupling together.

In another aspect, an electrical interconnection device is provided. The electrical interconnection device comprises a shell having a front end, a rear end, and an opening extending therethrough. The device further comprises a contact removably coupled within the shell. The device still further comprises a retaining ring configured to be secured within the shell to secure the contact to the shell.

In yet another aspect, a method is provided for coupling a contact and a shell. The method comprises inserting the contact within a shell opening defined at a rear end of the shell and securing a retaining ring within the shell in a front release configuration. The retaining ring is configured to removably couple the contact within the shell.

DETAILED DESCRIPTION OF THE INVENTION

Figure 1:
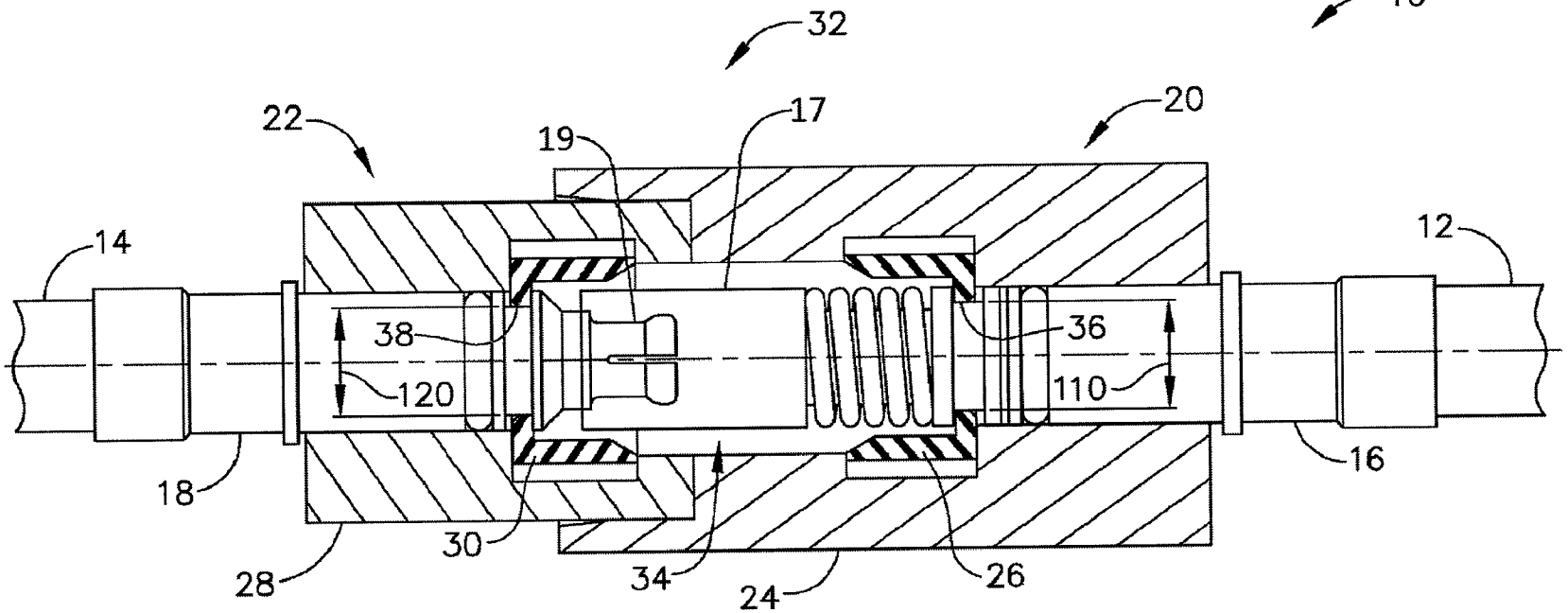
FIG. 1 is a cross-sectional illustration of an exemplary electrical interconnection system.

FIG. 1 is a cross-sectional view of an exemplary electrical interconnection system 10. Electrical interconnection system 10 facilitates maintaining an electrical coupling of a first conductor 12 and a second conductor 14. In the exemplary embodiment, first conductor 12 and second conductor 14 are electrical cables fabricated from, for example, but not limited to, copper, silver, gold, or any other conductive alloy that enables system 10 to function as described herein. In an alternative embodiment, first and second conductors 12 and 14 are fiber optic cables. However, first and second conductors 12 and 14 may be any conductor of electricity and/or light that allows system 10 to function as described herein. In the exemplary embodiment, first conductor 12 is coupled to a first contact 16, and second conductor 14 is coupled to a second contact 18. As such, in the exemplary embodiment, first contact 16 and second contact 18 include common mating surfaces 17 and 19, respectively, that facilitate coupling of first conductor 12 and second conductor 14. For example, first contact 16 may be a female-type connection 17 and second contact 18 may be a male-type connection 19 configured to mate with first contact 16. More specifically, second contact 18 may include a plurality of pins and first contact 16 may include a plurality of plugs 17 configured to align with the number and pattern of the pins 19 extending from contact 18.

System 10 includes a receptacle assembly 20 and a plug assembly 22. In the exemplary embodiment, receptacle assembly 20 includes a receptacle shell 24 and a retaining ring 26. Plug assembly 22 includes a plug shell 28 and a retaining ring 30. Receptacle shell 24 and plug shell 28 couple together to form a complete shell 32 that facilitates protecting an interior 34 of system 10. More specifically, receptacle shell 24 and plug shell 28 combine to facilitate protection of coupling surfaces of first conductor 12 and second conductor 14 from, for example, dust, water, and contaminants. In other words, receptacle shell 24 and plug shell 28 facilitate protecting the portion coupled together in electrical contact between first contact 16 and second contact 18.

In the exemplary embodiment, plug shell 28 is illustrated as fitting within a portion of receptacle shell 24. Plug shell 28 may be coupled to receptacle shell 24 using any known means that enables system 10 to function as described herein. For example, receptacle shell 24 and plug shell 28 may be coupled together by a coupling nut or a bayonet (not shown in FIG. 1). In the exemplary embodiment, retaining ring 26 includes an annular retaining ring flange 36 that extends radially inward from retaining ring 26. Retaining ring 26 facilitates coupling of first contact 16 to receptacle shell 24. In the exemplary embodiment, retaining ring 30 also includes an annular retaining ring flange 38 that extends radially inward from retaining ring 30. Retaining ring 30 secures second contact 18 to plug shell 28. System 10 facilitates securely coupling receptacle shell 24 and first contact 16, and securely coupling plug shell 28 and second contact 18.

Figure 2:
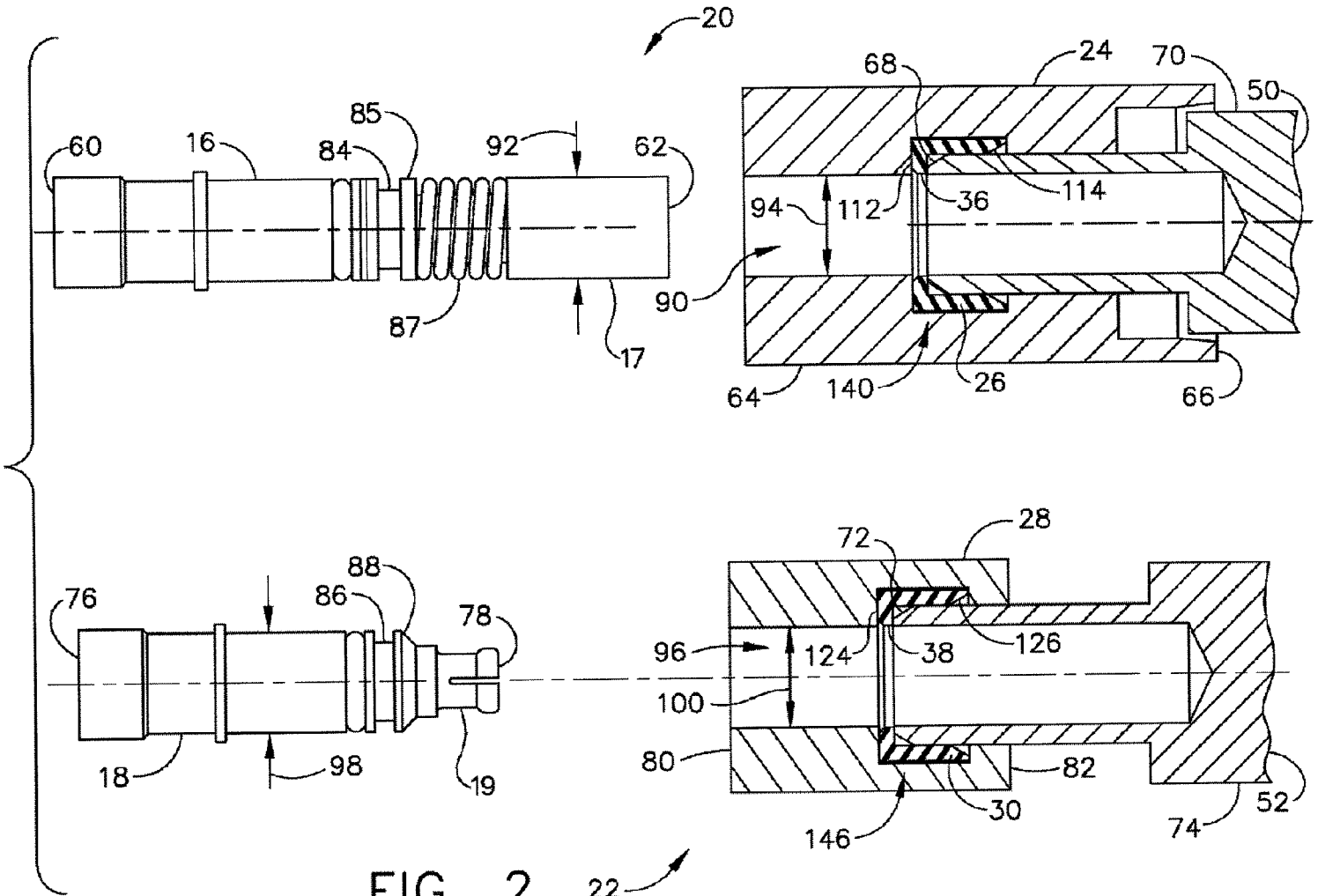
FIG. 2 is an exploded cross-sectional view of the electrical interconnection system shown in FIG. 1.

FIG. 2 is an exploded cross-sectional view of system 10. Components shown in FIG. 2 that are identical to those illustrated in FIG. 1 are identified with the same reference numerals. FIG. 2 also illustrates a receptacle contact installation/removal tool 50 and a plug contact installation/removal tool 52. As shown in FIG. 2, first contact 16 includes a first end 60 and a second end 62. Receptacle shell 24 includes a first end 64 and a second end 66. Tool 50 includes a first end 68 and a second end 70. Tool 52 includes a first end 72 and a second end 74. Second contact 18 includes a first end 76 and a second end 78, and plug shell 28 includes a first end 80 and a second end 82.

In the exemplary embodiment, first contact 16 and second contact 18 include common mating surfaces (not shown in FIG. 2). For example, first contact 16 may include a female-type connection (not shown in FIG. 2) at second end 62, and second contact 18 may include a male-type connection (not shown in FIG. 2) at second end 78 that is sized and oriented to mate with first contact 16. For example, in one embodiment, first contact 16 includes a connector similar to a MiniMulti-Port female connector and second contact 18 includes a connector similar to a MiniMulti-Port male connector. In another embodiment, first contact 16 and second contact 18 include variants of M8 Multi-Port connectors or V8 Multi-Port connectors. MiniMulti-Port connectors, M8 Multi-Port connectors, and V8 Multi-Port connectors are commercially available from Times Microwave Systems of Wallingford, Conn.

Moreover, in the exemplary embodiment, first contact 16 also includes a retaining channel 84 that is at least partially defined by a retention flange 85 and a biasing mechanism, or spring 87, disposed between the retention flange 85 and the mating surface 19. Retaining ring 26 and retaining channel 84 cooperate to facilitate securing contact 16 within receptacle shell 24. Furthermore, in the exemplary embodiment, second contact 18 includes a retaining channel 86 that is at least partially defined by a retention flange 88. Retaining ring 30 and retaining channel 86 cooperate to facilitate securing contact 16 within plug shell 28.

In the exemplary embodiment, receptacle shell 24 is a hollow cylindrical body. Receptacle shell 24 includes an opening 90 that is sized to enable first contact 16 to pass at least partially through receptacle shell 24. More specifically, an outer diameter 92 of first contact 16 is sized to fit snuggly within an inner diameter 94 of opening 90. Receptacle shell 24 is oriented such that second end 62 of first contact 16 may be inserted into opening 90 at shell first end 64.

Similarly, in the exemplary embodiment, plug shell 28 is a hollow cylindrical body. Plug shell 28 includes an opening 96 that is sized to enable second contact 18 to pass at least partially through plug shell 28. An outer diameter 98 of second contact 18 is sized to fit snuggly within an inner diameter 100 of opening 96. Plug shell 28 is oriented such that second end 78 of second contact 18 may be inserted into opening 96 at first end 80 of plug shell 28.

In an alternative embodiment, receptacle shell 24 includes a plurality of openings 90 and plug shell 28 includes a plurality of corresponding openings 96. Each individual opening 90 is positioned to align with a specific opening 96 when receptacle shell 24 and plug shell 28 are coupled together. In the alternative embodiment, a plurality of first contacts 16 are coupled to receptacle shell 24 and a plurality of second contacts 18 are coupled to plug shell 28. In combination, receptacle shell 24 and plug shell 28 facilitate protecting the plurality of interconnected first contacts 16 and second contacts 18. Multiple openings 90 and 96 in each of receptacle shell 24 and plug shell 28, respectively, facilitate simultaneously coupling a plurality of first contacts 16 to a plurality of second contacts 18. In other words, multiple openings 90 and 96 facilitate coupling a plurality of first contacts 16 to a plurality of second contacts 18 without having to individually couple each of the plurality of first contacts 16 to the corresponding second contact 18.

Retaining ring 26, in the exemplary embodiment, is a cylindrical ring that has a first inside diameter 110 (shown in FIG. 1) and that is able to expand to a second inside diameter that is sized substantially the same as inner diameter 94 (shown in FIG. 2), through the use of tool 50. In the exemplary embodiment, retaining ring 26 includes retaining ring flange 36 at a first end 112 of retaining ring 26, and is beveled at a second end 114.

Similarly, in the exemplary embodiment, retaining ring 30 is a cylindrical ring that has first inside diameter 120 (shown in FIG. 1) and that is to expand to a second inside diameter that is sized substantially the same as inner diameter 100 (shown in FIG. 2), through the use of tool 52. In the exemplary embodiment, retaining ring 30 includes retaining ring flange 38 at a first end 124 of retaining ring 30, and is beveled at a second end 126.

Receptacle shell 24 includes an annular recess 140 that facilitates securing retaining ring 26 within receptacle shell 24. More specifically, retaining ring 26 is sized to fit within annular recess 140, and when first contact 16 is inserted into opening 90, retaining ring flange 36 is sized and oriented to extend into retaining channel 84 to facilitate securing first contact 16 within receptacle shell 24. Plug shell 28 includes an annular recess 146 that facilitates securing retaining ring 30 within plug shell 28. More specifically, retaining ring 30 is sized to fit within annular recess 146, and when second contact 18 is inserted into opening 96, retaining ring flange 38 is sized and oriented to extend into retaining channel 86 to facilitate securing second contact 18 within plug shell 28. Additionally, by securing retaining rings 26 and 30 within receptacle shell 24 and plug shell 28, respectively, annular recess 140 and annular recess 146 facilitate preventing the inadvertent loss of retaining rings 26 and 30.

Installation/removal tool 50 is sized and oriented to fit within opening 90, when a first end 68 of tool 50 is inserted into opening 90 at second end 66 of receptacle shell 24. When inserted, tool 50 extends into opening 90 and is positioned in contact with retaining ring 26. Tool 50 forces retaining ring 26 to expand from first inside diameter 110 to second inside diameter 94. Beveled second end 114 of retaining ring 26 facilitates reducing the force necessary for tool 50 to expand retaining ring 26.

More specifically, in the exemplary embodiment, the configuration of installation/removal tool 50 and receptacle assembly 20 is referred to as a front release configuration. To facilitate installing and securing contact 16 within receptacle shell 24, installation/removal tool 50 is inserted into opening 90 at second end 66, also referred to as the front, of receptacle shell 24. In contrast, to remove contact 16 from a shell having a rear release configuration, a tool must be inserted into an opening similar to opening 90 from first end 64 in order to release, for example, a circular leaf spring that secures the contact within the shell. As such, a rear release tool must fit between the contact and the shell opening, which on a rear end of a shell, is often insulated to protect the interior 34 (shown in FIG. 1) from contaminants. However, the insulation and/or small clearance between the contact and the shell opening may make removal of the contact from the shell difficult, which may lead to damage to the circular leaf spring. In contrast, in the exemplary embodiment, system interior 34 is protected from contaminants by receptacle shell 24 and plug shell 28. As such, second end 66 of opening 90 is not insulated, such that a larger clearance is defined between contact 16 and opening 90 at interior 34. The larger clearance reduces the difficulty of positioning installation/removal tool 50 between contact 16 and retaining ring 26. By reducing the difficulty of positioning tool 50, a risk of damaging retaining ring 26 is facilitated to be reduced.

Installation/removal tool 52 operates in a substantially similar manner as tool 50. Furthermore, tool 52 is configured to extend into opening 96 to force retaining ring 30 to expand from first inside diameter 120 to second inside diameter 100, similar to tool 50 extending into opening 90 to force retaining ring 26 into an expanded diameter. In an alternative embodiment, receptacle assembly 20 and plug assembly 22 are configured such that a single installation/removal tool may be used for installation/removal of first contact 16 and second contact 18. In the alternative embodiment, installation/removal tools 50 and 52 are identical.

As described above with respect to receptacle assembly 20, plug assembly 22 also has a front release configuration. The description of front release receptacle assembly 20 also applies to front release plug assembly 22.

Figure 3:
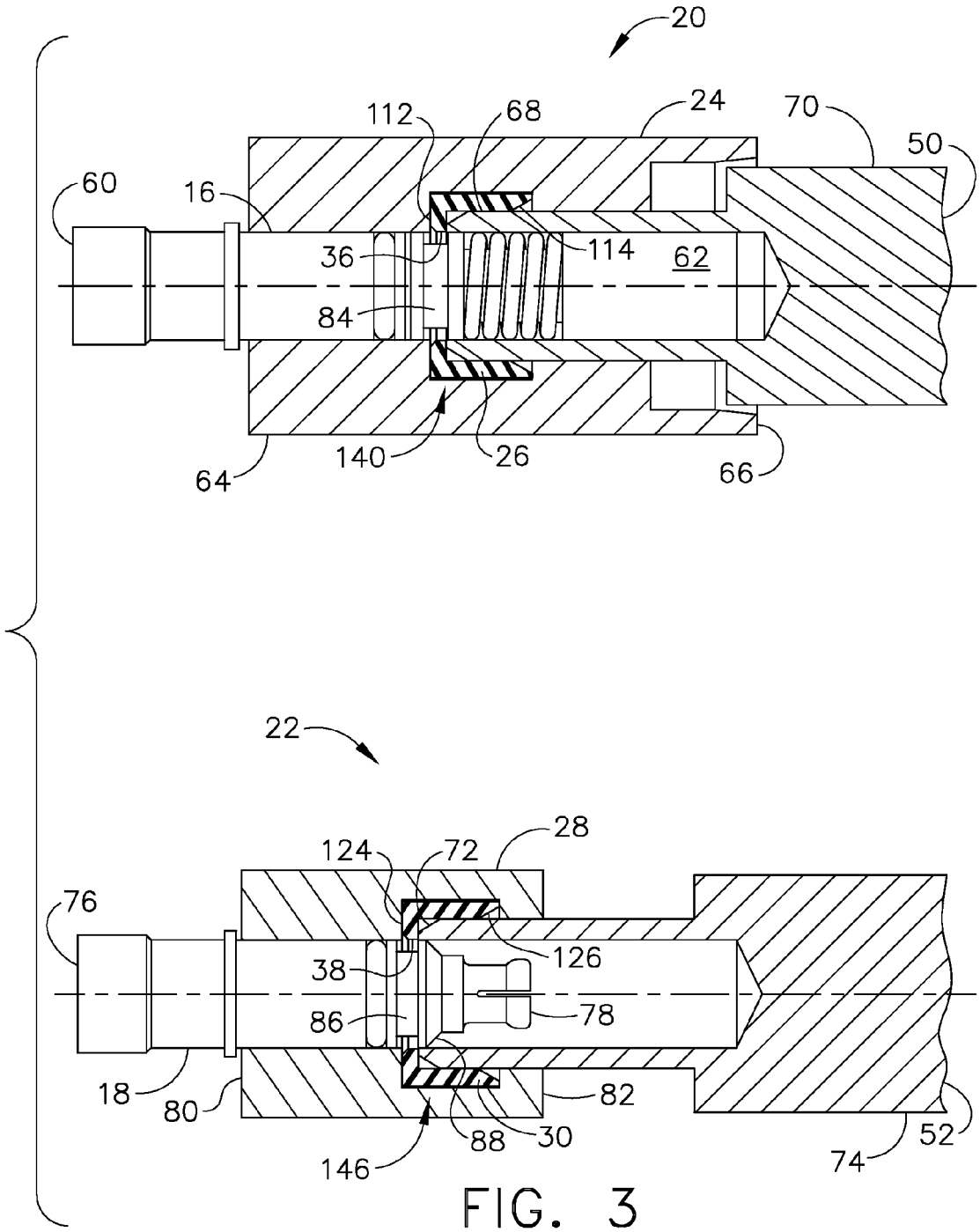
FIG. 3 is a cross-sectional view of the components shown in FIG. 2, with a first contact within a receptacle shell, and a second contact within a plug shell.

FIG. 3 is a cross-sectional view of the components illustrated in FIG. 2, and includes first contact 16 within receptacle shell 24 and second contact 18 within plug shell 28. Components shown in FIG. 3 that are also shown in FIGS. 1 and 2 are identified with the same reference numerals. Moreover, in the exemplary embodiment, installation/removal tool 50 secures retaining ring 26 in an expanded form, which facilitates the insertion of contact 16 into opening 90. Similarly, installation/removal tool 52 secures retaining ring 30 in an expanded form, which facilitates the insertion of contact 18 into opening 96.

Figure 4:
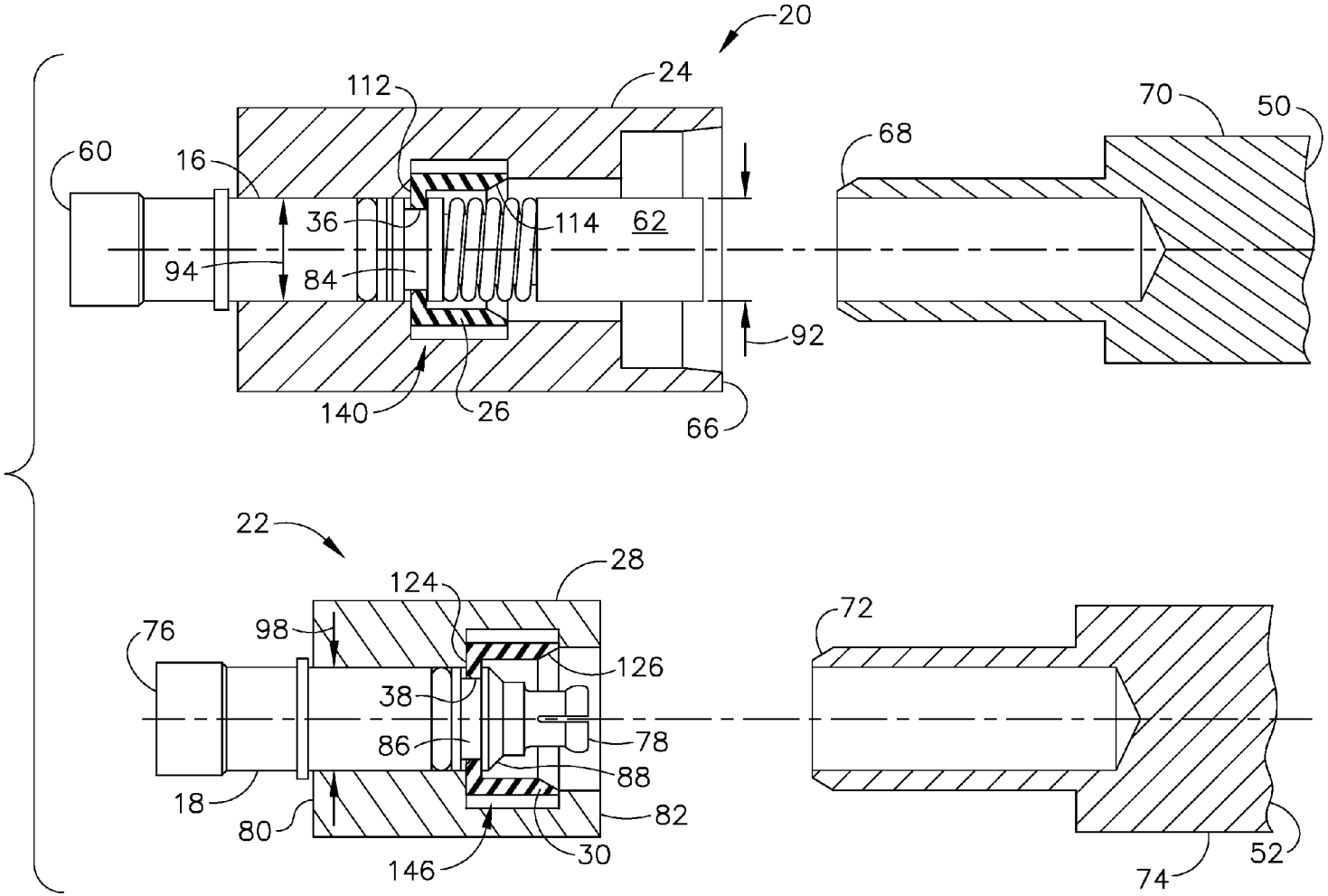
FIG. 4 is a cross-sectional view of the components shown in FIGS. 2 and 3, illustrating the first contact secured within the receptacle shell and the second contact secured within the plug shell, and the installation/removal tools removed.

FIG. 4 is a cross-sectional view of the components shown in FIGS. 2 and 3, wherein first contact 16 is secured within receptacle shell 24 and second contact 18 secured within plug shell 28. In the exemplary embodiments illustrated, first and second installation/removal tools 50 and 52 are removed. When installation/removal tool 50 is removed from opening 90, retaining ring 26 collapses, causing retaining ring flange 36 to fit within retaining channel 84. When installation/removal tool 52 is removed from opening 96, retaining ring 30 collapses, causing retaining ring flange 38 to fit within retaining channel 86. In an alternative embodiment, at least one of first contact 16 and second contact 18 is configured such that installation/removal tool 50 and/or installation/removal tool 52 is not required for installation of first contact 16 and/or second contact 18. For example, retention flange 88 may be beveled in order to reduce friction as second contact 18 transitions past retaining ring flange 38.

Figure 5:
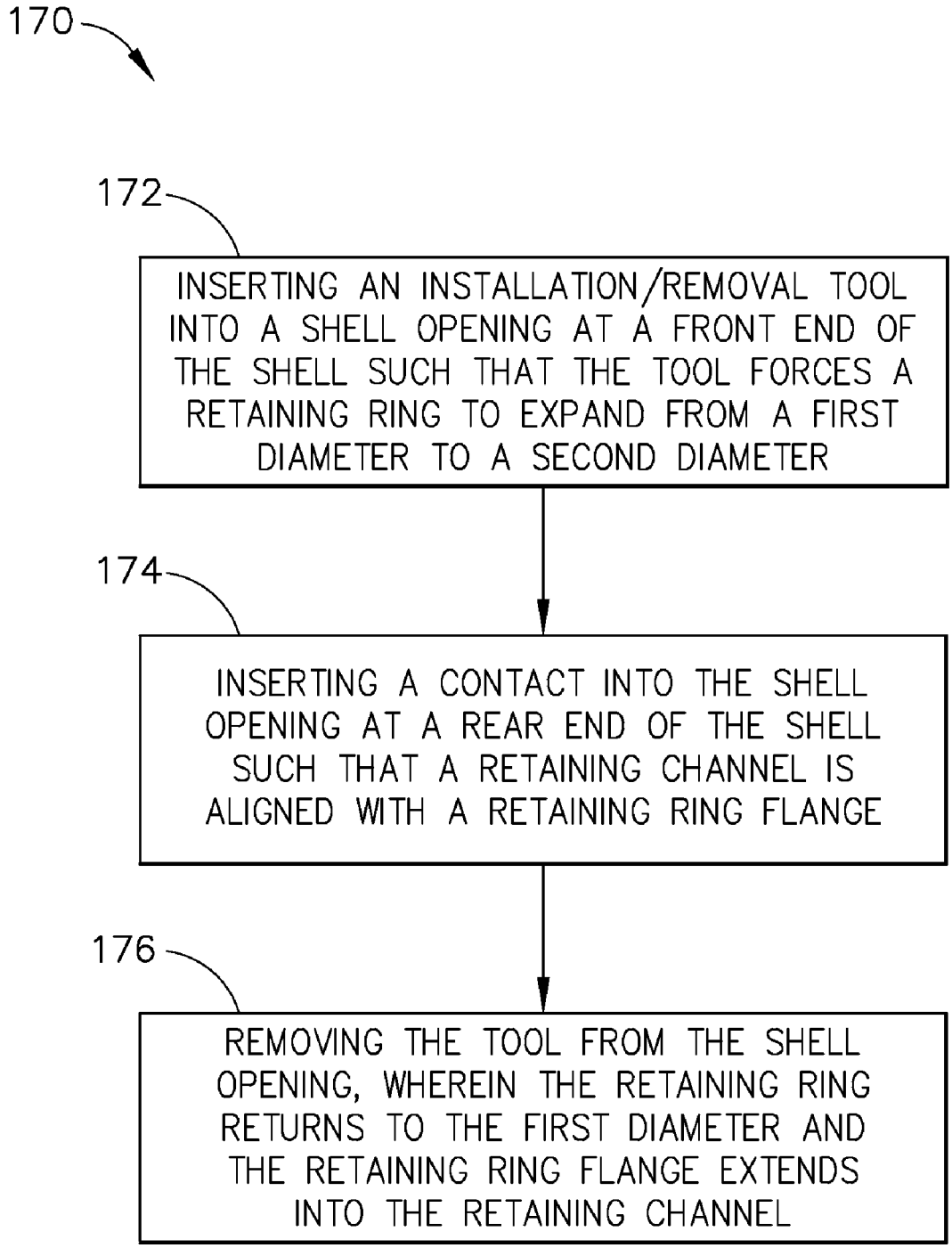
FIG. 5 is a flow chart illustrating an exemplary method for removably coupling a contact to a shell using the electrical interconnection system shown in FIGS. 1-4.

FIG. 5 is a flow chart illustrating an exemplary method 170 for removably coupling a contact to a shell, for example, coupling contact 16 to receptacle shell 24 (shown in FIG. 1). Method 170 includes inserting 172 an installation/removal tool into a shell opening at a front end of the shell such that the tool forces a retaining ring to expand from a first diameter to a second diameter. Method 170 also includes inserting 174 a contact into the shell opening at a rear end of the shell such that a retaining channel is aligned with a retaining ring flange. Method 170 still further includes removing 176 the tool from the shell opening, such that the retaining ring returns to the first diameter and the retaining ring flange extends into the retaining channel. Since the retaining ring is held within the shell, and the retaining ring extends into the retaining channel of the contact, the contact is removably coupled to the shell. To remove the contact from the shell, the installation/removal tool is inserted 172 into the shell opening at the front end of the shell, expanding the retaining ring from the first diameter to the second diameter, which removes the retaining ring flange from the retaining channel and allows the contact to be removed from the shell.

Described herein are exemplary methods and systems to facilitate secure interconnection of cables. More specifically, the methods described herein can be utilized to economically and efficiently interconnect cables while protecting the interconnections from outside contaminants. The design of the retaining rings and contacts, facilitates a reduction in damage to the retaining rings when compared to known rear release contacts, and facilitates easier access to the retaining rings for installation/removal of the contacts.

Although the systems and methods described and/or illustrated herein are described and/or illustrated with respect to electrical and/or fiber optic cables, practice of the systems and methods described and/or illustrated herein is not limited to such cables. Rather, the systems and methods described and/or illustrated herein are applicable to any type of interconnection.

Exemplary embodiments of systems and methods are described and/or illustrated herein in detail. The systems and methods are not limited to the specific embodiments described herein, but rather, components of each system, as well as steps of each method, may be utilized independently and separately from other components and steps described herein. Each component, and each method step, can also be used in combination with other components and/or method steps.

When introducing elements/components/etc. of the assemblies and methods described and/or illustrated herein, the articles "a", "an", "the" and "said" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for making a first electrical interconnection device comprising the steps of:

providing a first shell with a front end, a rear end, and an opening extending therethrough;

securing a first retaining ring within said rear end of said first shell;

providing a first contact with a first mating surface, a retention flange, and a biasing mechanism disposed between said first mating surface and said retention flange; and removably coupling said first contact within said rear end of said first shell with said first retaining ring.

2. The method of claim 1, wherein said first retaining ring is expandable from a first diameter to a second diameter.

3. The method of claim 2, wherein said step of securing said first retaining ring within said first shell includes inserting an installation/removal tool into said front end of said first shell such that said first retaining ring is forced to expand to said second diameter.

4. The method of claim 2, wherein said first shell comprises an annular recess sized to secure said first retaining ring within said first shell.

5. The method of claim 1, wherein said first retaining ring comprises at least one retaining ring flange.

6. The method of claim 5, wherein said first contact comprises at least one retaining channel configured to align with said retaining ring flange during said step of removably coupling said first contact within said rear end of said first shell, said at least one retaining channel being at least partially defined by the retention flange.

7. The method of claim 1, wherein said first mating surface is configured to couple with a corresponding second mating surface of a second contact.

8. The method of claim 7, further comprising the steps of:

providing a second shell with a front end, a rear end, and an opening extending therethrough, said second shell being configured to couple with said first shell;

securing a second retaining ring within said rear end of said second shell; and removably coupling said second contact within said rear end of said second shell with said second retaining ring, wherein said second retaining ring is configured to secure said second contact to said second shell.

9. The method of claim 8, further comprising the step of coupling said first shell with said second shell, wherein coupling said first shell with said second shell aligns and couples said first with said second contact.

10. The method of claim 8, wherein said device is a front release style assembly.

11. The method of claim 8, wherein said second retaining ring is expandable from a first diameter to a second diameter.

12. The method of claim 8, wherein said step of securing said second retaining ring within said second shell includes inserting an installation/removal tool into said front end of said second shell such that said second retaining ring is forced to expand to said second diameter.

13. The method of claim 8, wherein said second shell comprises an annular recess sized to secure said second retaining ring within said second shell.

14. The method of claim 8, wherein said second retaining ring comprises at least one retaining ring flange.

15. The method of claim 14, wherein said second contact comprises at least one retaining channel configured to align with said retaining ring flange during said step of removably coupling said second contact within said second shell.

* * * * *